US011092412B2

(12) United States Patent
Durand et al.

(10) Patent No.: US 11,092,412 B2
(45) Date of Patent: Aug. 17, 2021

(54) DEVICE FOR DEFLECTING A STREAM OF PARTICLES FOR A PROJECTILE GUIDED BY A LINK WIRE

(71) Applicant: MBDA France, Le Plessis Robinson (FR)

(72) Inventors: François Durand, Le Plessis Robinson (FR); Vincent Cheret, Le Plessis Robinson (FR); Simon Tusseau, Le Plessis Robinson (FR); Vincent Guibout, Le Plessis Robinson (FR)

(73) Assignee: MBDA France, Le Plessis Robinson (FR)

( * ) Notice: Subject to any disclaimer, the term of this patent is extended or adjusted under 35 U.S.C. 154(b) by 0 days.

(21) Appl. No.: 16/629,526

(22) PCT Filed: Jun. 28, 2018

(86) PCT No.: PCT/FR2018/000181
§ 371 (c)(1),
(2) Date: Jan. 8, 2020

(87) PCT Pub. No.: WO2019/012189
PCT Pub. Date: Jan. 17, 2019

(65) Prior Publication Data

US 2020/0149849 A1 May 14, 2020

(30) Foreign Application Priority Data

Jul. 12, 2017 (FR) ..... 1700755

(51) Int. Cl.
*F42B 15/04* (2006.01)

(52) U.S. Cl.
CPC ..... *F42B 15/04* (2013.01)

(58) Field of Classification Search
CPC ..... F42B 10/60; F42B 10/32; F42B 10/34; F42B 10/38; F42B 10/40; F42B 10/66;
(Continued)

(56) References Cited

U.S. PATENT DOCUMENTS 3,690,595 A * 9/1972 Rusbach ..... F42B 10/14 244/3.27
4,967,980 A * 11/1990 Pinson ..... B65H 49/02 242/128

(Continued)

FOREIGN PATENT DOCUMENTS

DE 40 30 712 A1 4/1992
EP 2887005 A1 6/2015

OTHER PUBLICATIONS

International Search Report dated Oct. 9, 2018, issued in corresponding International Application No. PCT/FR2018/000181, filed Jun. 28, 2018, 5 pages.

(Continued)

*Primary Examiner* — John Cooper
(74) *Attorney, Agent, or Firm* — Christensen O'Connor Johnson Kindness PLLC

(57) ABSTRACT

A device is configured for deflecting a stream of particles for a projectile guided by a link wire, the projectile having a fuselage and an engine capable of producing a propulsive jet containing the stream of particles. The device includes a device support including an inner surface configured to attach the device support to the fuselage of the projectile, and a deflector strip assuming at least an unfolded position in which the deflector strip forms an angle with the device support in order to deflect the stream of particles.

12 Claims, 6 Drawing Sheets

(58) Field of Classification Search
CPC .... F42B 10/661; F42B 10/663; F42B 10/665; F42B 15/04
USPC ..... 102/490, 504, 324, 348
See application file for complete search history.

(56) References Cited

U.S. PATENT DOCUMENTS 5,056,406 A * 10/1991 Pinson ..... F42B 15/04 89/1.816
5,143,319 A * 9/1992 LeCompte ..... F41G 7/32 244/3.12
5,161,208 A * 11/1992 Christie ..... B65H 55/00 156/166
5,179,612 A * 1/1993 Rochester ..... G02B 6/4457 244/3.12
5,189,253 A * 2/1993 LeCompte ..... B65H 57/18 102/504
5,678,785 A * 10/1997 Porter ..... B65H 49/02 102/504
6,502,785 B1 * 1/2003 Teter ..... F42B 10/64 244/3.22
7,004,424 B1 * 2/2006 Pacchia ..... F42B 10/50 102/348
7,642,492 B2 * 1/2010 Parine ..... F42B 10/14 244/3.27
8,193,476 B2 * 6/2012 Olden ..... F42B 10/668 244/3.27

OTHER PUBLICATIONS

Written Opinion of the International Searching Authority dated Oct. 9, 2018, issued in corresponding International Application No. PCT/FR2018/000181, filed Jun. 28, 2018, 5 pages.
Written Opinion of the International Searching Authority dated Oct. 9, 2018, issued in corresponding International Application No. PCT/FR2018/000181, filed Jun. 28, 2018, 4 pages.
International Preliminary Report on Patentability dated Jan. 14, 2020, issued in corresponding International Application No. PCT/FR2018/000181, filed Jun. 28, 2018, 1 page.

* cited by examiner

DEVICE FOR DEFLECTING A STREAM OF PARTICLES FOR A PROJECTILE GUIDED BY A LINK WIRE

TECHNICAL FIELD

The present invention relates to a device for deflecting a stream of particles for a projectile guided by a link wire.

STATE OF THE ART

There are several techniques for guiding self-propelled projectiles, in particular, missiles. In particular, short-range projectiles can be guided using a link wire which connects the projectile to a firing post. Command orders for guiding the projectile are transmitted from the firing post to the projectile by way of the link wire which can be an optical fibre or an electrical cable. The link wire also makes it possible to transmit to the firing post, images making it possible to view a target to be reached. During the flight of the projectile, the link wire is unwound behind the projectile in a circular scanning of the link wire. Generally, this type of projectile is provided with a main engine of which the ejection outlet is situated laterally to the projectile, such that the propulsive jet coming from the main engine does not damage the link wire. Yet, despite this precaution, the link wire may be damaged. Indeed, the combustion of the main engine is not effective all throughout the flight of the projectile. This has the disadvantage that all the particles comprised in the propulsive jet are not ejected outside of the limit layer which surrounds the body of the projectile. The particles, prisoner of the limit layer follow the body of the projectile and are located in the circular scanning zone of the link wire, which can have the consequence of breaking said link wire.

SUMMARY OF THE INVENTION

The present invention has the aim of overcoming these disadvantages by proposing a device for deflecting a stream of particles for a projectile, in particular a missile.

To this end, the invention relates to a device for deflecting a stream of particles for a projectile guided by a link wire along a movement direction of the projectile, the projectile being provided with a fuselage and an engine capable of producing a propulsive jet ejected through an ejection outlet of the engine from upstream to downstream in the movement direction of the projectile, the propulsive jet containing the stream of particles.

According to the invention, the device comprises:

- a device support comprising an outer surface and an inner surface, the inner surface corresponding to a surface configured to attach the device support to the fuselage of the projectile,
- a deflector strip downstream of the ejection outlet,
- a module for actuating the deflector strip making it possible to bring the deflector strip from the folded position in which the deflector strip is situated substantially in line with the device support to an unfolded position in which the deflector strip forms a (non-zero) angle with the device support to deflect the stream of particles.

Thus, according to the invention, the stream of particles is deflected by the deflector strip (when it is brought into the unfolded position) which prevents the particles from remaining confined in the limit layer which surrounds the body of the projectile during the flight. The deflector strip in the unfolded position thus removes any risk of interactions between the stream of particles and the link wire, thus avoiding the breaking of the link wire.

Furthermore, the actuation module comprises:

- a return element configured to exert a first force capable of bringing the deflector strip from the folded position to the unfolded position,
- a retaining element configured to exert a second force capable of countering the first force to maintain the deflector strip in the folded position; the return element being configured to bring the deflector strip from the folded position to the unfolded position, when the propulsive jet destroys at least one portion of the retaining element, the deflector strip being in pivot connection with the device support.

Thanks to the combined action of the return element and the retaining element, the deflector strip can be retracted at the time of the launch of the projectile. Thus, the deflector strip does not disturb the launch by friction with the launch tube. The retaining element makes it possible to maintain the deflector strip in line with the device support during the launch. Then, the propulsive jet destroys at least one portion of the retaining element such that the return element can bring the deflector strip into a position in which it can deflect the jet of particles.

According to one embodiment, the deflector strip comprises a front surface and a rear surface, the rear surface facing the fuselage, the device support being provided with at least one abutment against which the rear surface of the deflector strip is supported when the deflector strip is in the folded position.

According to another embodiment, the device support comprises a passage opening configured to surround the ejection outlet of the engine, the deflector strip being situated downstream of the passage opening.

Furthermore, the retaining element comprises a retaining element stretched through the passage opening.

In addition, the inner surface of the device support comprises at least one stud arranged upstream of the passage opening, the deflector strip comprising a first longitudinal end in pivotal connection with the device support and a second longitudinal end opposite the first longitudinal end, the second longitudinal end being provided with at least one flap extending opposite the first longitudinal end, the retaining wire forming a loop arranged to pass around the flap(s) on one side of the loop and around the stud(s) on the other side of the loop, the loop being capable of bearing on the flap(s) of the deflector strip to maintain said deflector strip in the folded position.

Moreover, the loop comprises two strands, each forming respectively a portion of the loop, each of the two strands being arranged to, starting with the flap(s) to the stud(s):

- follow at least one lower recess formed on the inner surface of the device support at least partially in the abutment(s) against which the rear face of the deflector strip is supported when the deflector strip is in the folded position,
- pass from the inner surface of the device support to the outer surface of the device support through an opening arranged through the device support,
- follow at least one first upper recess formed on the outer surface of the device support,
- join at least one second upper recess opposite the first upper recess with respect to the passage opening,
- pass from the outer surface of the device support to the inner surface of the device support through a passage slot formed through the device support.

For example, the loop is closed by a set of knots produced at the ends of the link wire, the set of knots depending on the type of the retaining wire.

According to an embodiment, the return element comprises a leaf spring, the leaf spring comprising a spring support arranged in at least one groove of the device support, the spring support being provided with pads configured to be supported under the fuselage of the projectile when the device is attached to the fuselage of the projectile.

Preferably, the device support has a continually increasing thickness from upstream to downstream.

The invention also relates to a missile comprising at least one device for deflecting a stream of particles such as described above.

BRIEF DESCRIPTION OF THE FIGURES

The invention, with the features and advantages thereof, will emerge more clearly upon reading the description made in reference to the appended drawings, in which.

DETAILED DESCRIPTION

Below, the description will make reference to the figures cited above.

Figure 1:
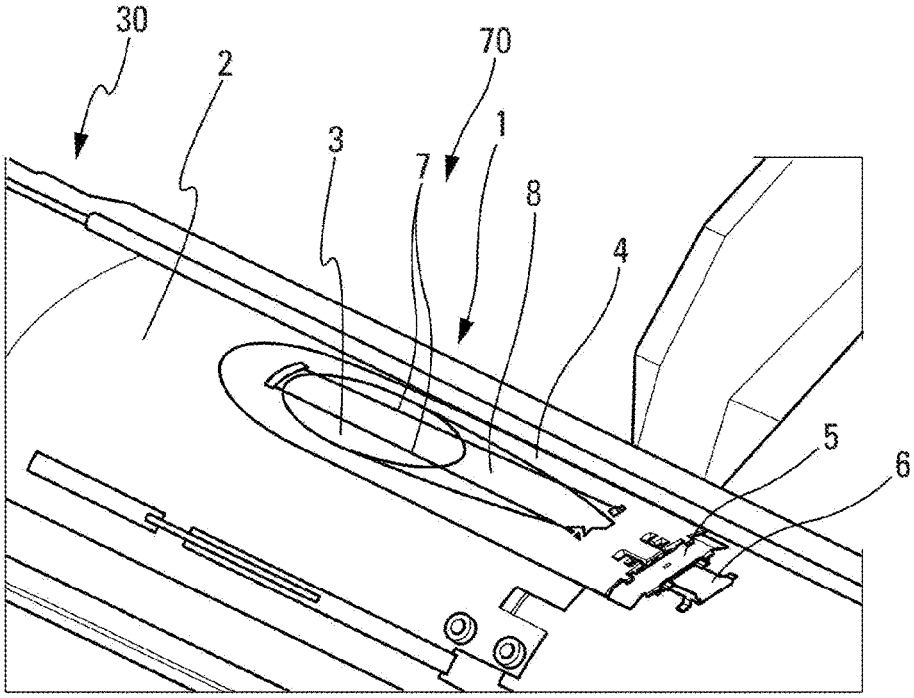
FIG. 1 represents a perspective view of a fuselage portion of a projectile on which is attached a deflector device.
Figure 2:
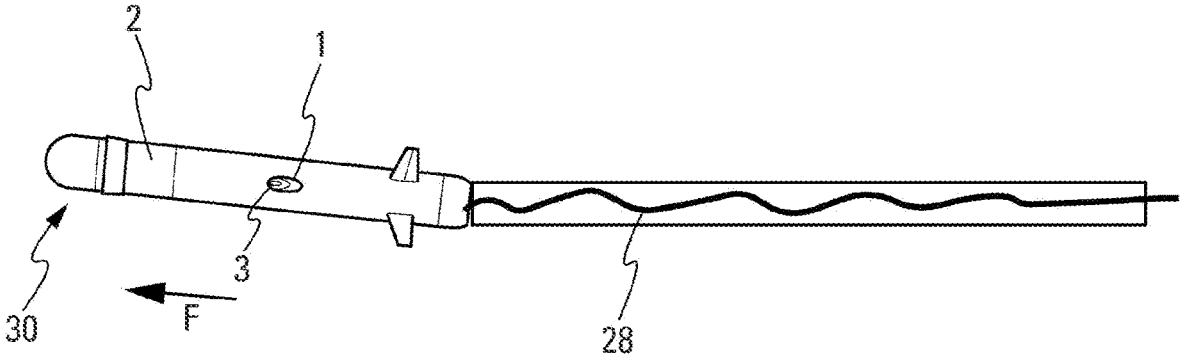
FIG. 2 represents a profile view of a missile guided by a link wire.
Figure 3:
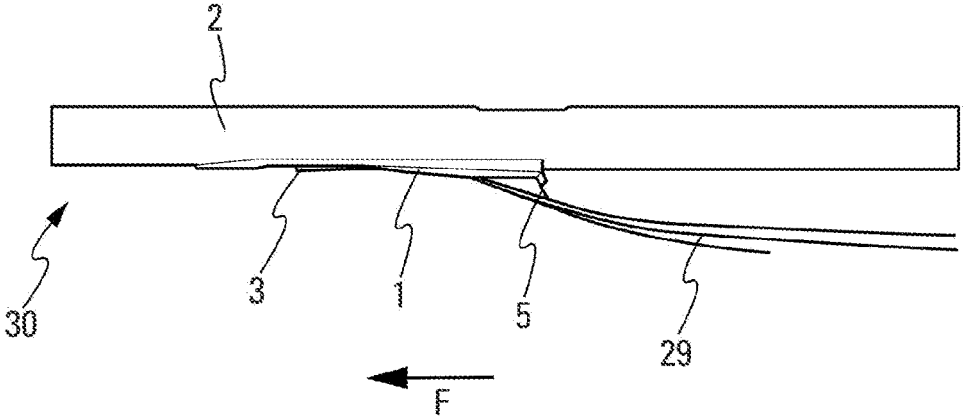
FIG. 3 represents a profile view of a projectile, of which the stream of particles is deflected by a deflector device attached on the fuselage of the missile.

The invention relates to a device 1 for deflecting a stream of particles 29 for a projectile 30 guided by a link wire 28 along a movement direction represented by the arrow referenced F in FIGS. 2 and 3.

The projectile 30 is provided with a fuselage 2 and an engine capable of producing a propulsive jet ejected through an ejection outlet 3 of the engine from upstream to downstream in the movement direction F of the projectile 30. The propulsive jet comprises the stream of particles 29. The fuselage 2 can comprise several portions. For example, the fuselage 2 can comprise a front portion forming the front of the projectile 30 and a rear portion forming the rear of the projectile 30.

The deflector device 1 comprises a device support 4 comprising an outer surface and an inner surface. The inner surface corresponds to a surface configured to attach the device support 4 to the fuselage 2 of the projectile 30.

Figure 17:
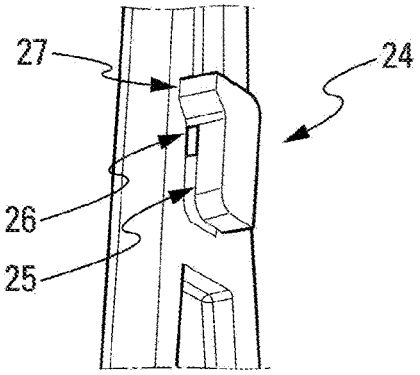
FIG. 17 represents an element for attaching the device support to the fuselage of the projectile.

According to an embodiment, the device support 4 comprises at least one attachment element 24 arranged on the inner surface of the device support 4 (FIG. 17). For example, the attachment element 24 is arranged in hook form to be able to be triggered with an attachment element of the fuselage 2 of a projectile 30. The attachment element 24 can comprise a lateral guide 27 configured to guide the device support 4 with respect to the attachment element of the fuselage 2. The attachment element 24 also comprises a surface 25 and a longitudinal abutment 26 to wedge the device support 4 with the fuselage 2 of the projectile 30. The attachment of the device support 4 by at least one attachment element 24 on the fuselage 2 can be completed by adding an adhesive strip.

Advantageously, the attachment element of the fuselage 2 corresponds to an L-shaped slot produced through the fuselage 2, in which the attachment element 24 is triggered.

Figure 7:
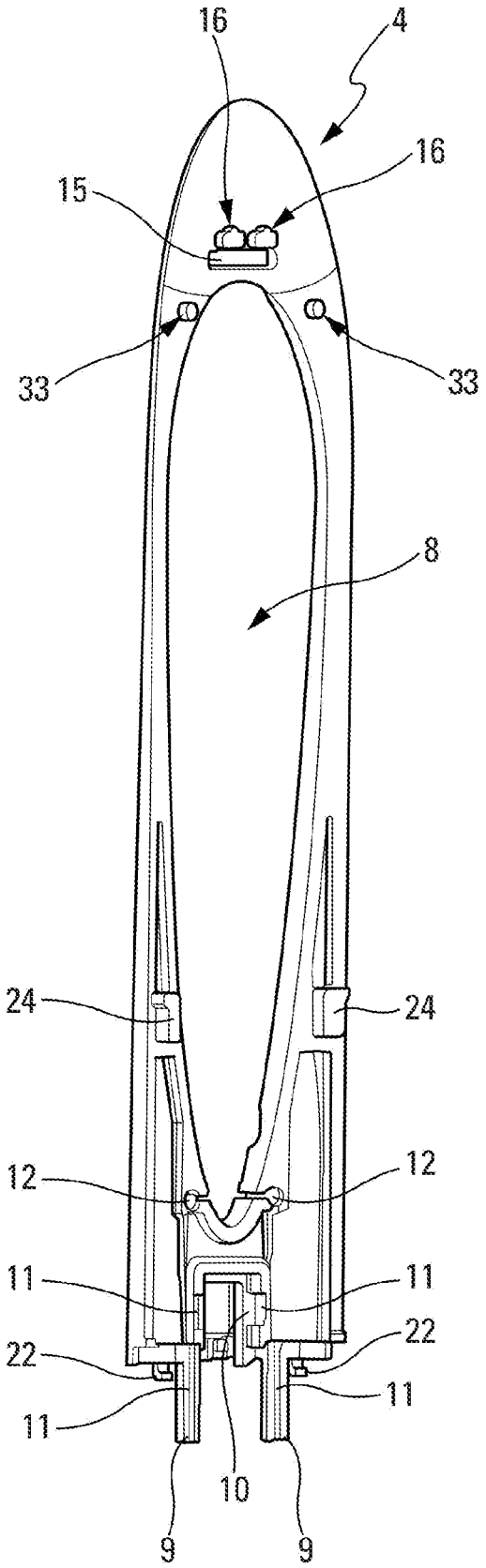
FIG. 7 represents a view of the inner surface of the device support.

For example, in FIG. 7, two attachment elements 24 are situated downstream of the device support 4. An adhesive strip arranged upstream of the device support 4 can complete the attachment of the device support 4 to the fuselage 2.

Support studs 33 can be arranged on the inner surface of the device support 4. These support studs 33 with the attachment element(s) 24 make it possible to angularly orient the device support 4 with respect to the longitudinal axis of the projectile 30.

The deflector device 1 further comprises a deflector strip 5 (FIG. 8) downstream of the ejection outlet 3 and a module for actuating the deflector strip 5. The actuation module makes it possible to bring the deflector strip 5 from the folded position, in which the deflector strip 5 is situated substantially in line with the device support 4 to a folded position in which the deflector strip 5 forms an angle with the device support 4 to deflect the stream of particles 29.

The deflector strip 5 comprises a front surface 55 and a rear surface 56. The rear surface 56 of the deflector strip 5 faces the fuselage 2.

A projectile 30, such as a missile, is generally fired by a firing point which comprises a launch tube. The deflector strip 5 can prevent a correct launch of the projectile 30 through friction between said deflector strip 5 and the launch tube. To avoid that friction being produced, the deflector strip 5 is presented in the folded position by being retracted at the time of the launch of the projectile 30 thanks to the actuation module.

Advantageously, the device support 4 is provided with at least one abutment 9 against which at least the rear surface 56 of the deflector strip 5 is supported when the deflector strip 5 is in the folded position.

In an embodiment, the actuation module comprises a return element 6 and a retaining element 70.

Figure 5:
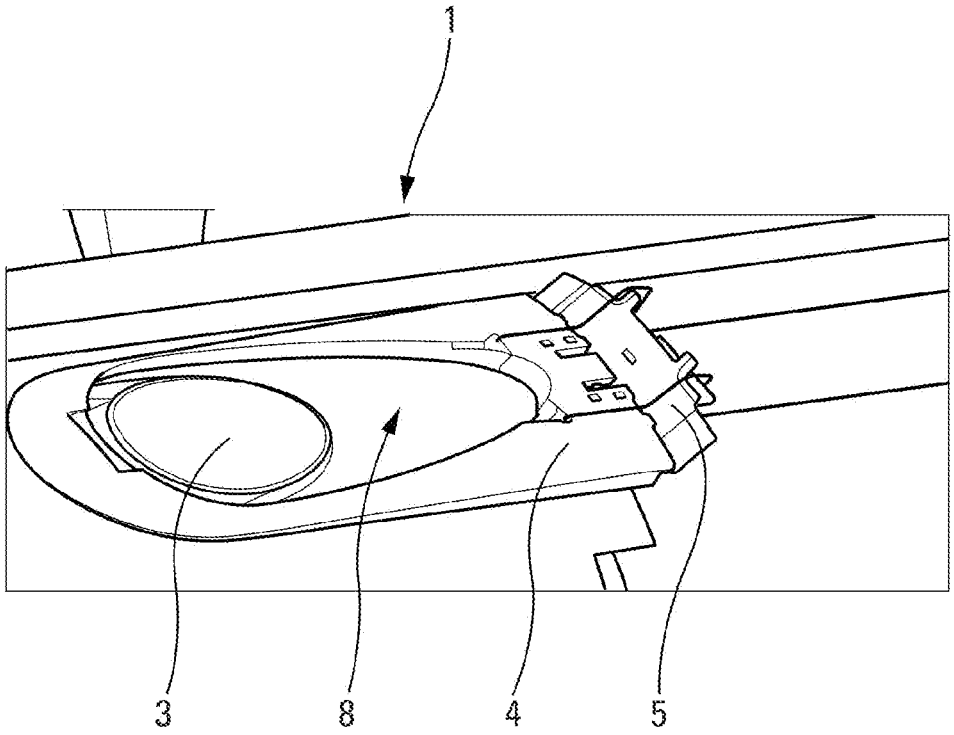
FIG. 5 represents a perspective view of the deflector device in the folded position.
Figure 11:
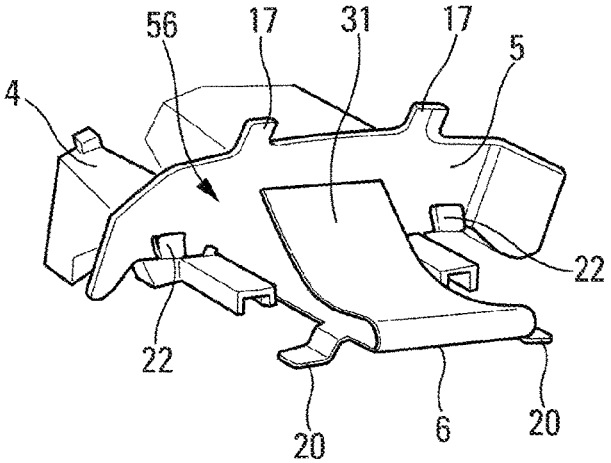
FIG. 11 represents a perspective view of a portion of the outer surface with the deflector strip in the unfolded position thereof.

The return element 6 is configured to exert a first force capable of bringing the deflector strip 5 from the folded position to the unfolded position (FIGS. 5 and 11).

Figure 9:
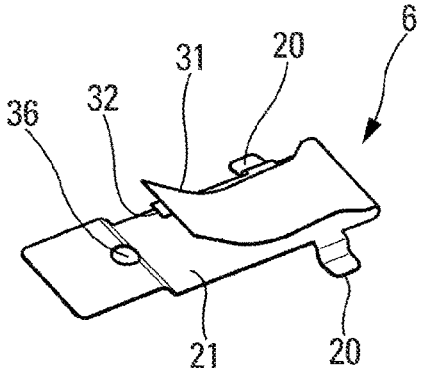
FIG. 9 represents a perspective view of the return element according to an embodiment.
Figure 10:
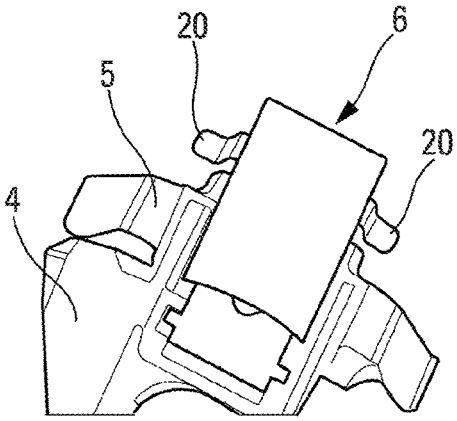
FIG. 10 represents a perspective view of a portion of the inner surface of the device support on which is attached the return element.
Figure 18:
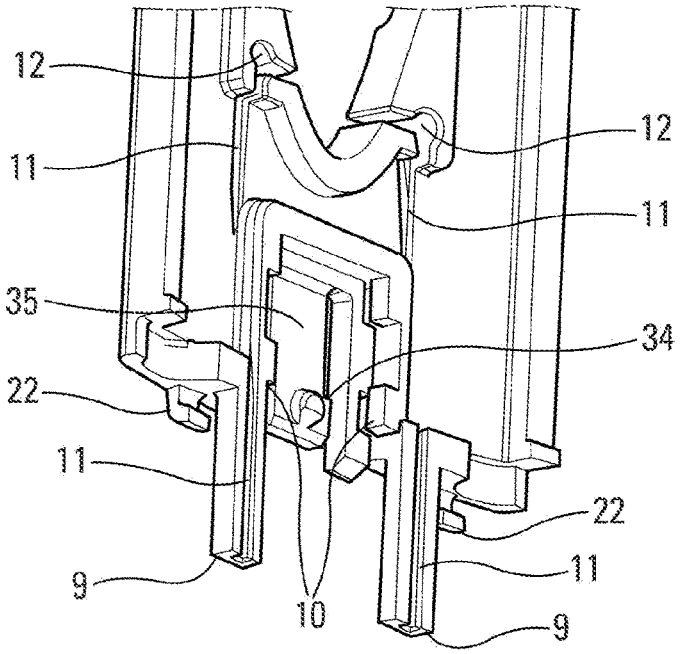
FIG. 18 represents an upstream portion of the inner surface of the device support, FIG. 19 *a* to *c* represent the steps making it possible to produce the set of knots to form the loop from the retaining wire, FIG. 20 schematically represents steps of the method for assembling the deflector device.

According to an embodiment, the return element 6 comprises a leaf spring 31 (FIG. 9). The leaf spring 31 is provided with a spring support 21 arranged in at least one groove 10 of the device support 4. An attachment flap 35 comprises a boss 34 (FIG. 18) configured to enter into an attachment orifice 36 arranged in the spring support 21 (FIG. 9) in order to block the return element in the groove 10. When the return element 6 is assembled to the device support 4, the attachment flap 35 bears on the spring support 21 until the boss 34 enters into the attachment orifice 36 of the spring support 21. The spring support 21 is provided with pads 20. These pads 20 are configured to be under the fuselage 2 when the device 1 is fixed on the fuselage 2 of the projectile 30. These pads 20 are arranged under the fuselage 2 through the insertion thereof through the L-shaped slots produced on the fuselage 2.

In order to connect the deflector strip 5 to the return element 6, the leaf spring 31 can be provided with a flap 32 (FIG. 9) which passes through the deflector strip 5 through an orifice 19 (FIG. 8) arranged in the deflector strip 5 (FIG. 11).

The retaining element 70 is configured to exert a second force capable of countering the first force to maintain the deflector strip 5 in the folded position. In the folded position, the deflector strip 5 is retracted.

The return element 6 is thus configured to bring the deflector strip 5 from the folded position to the unfolded position, when the propulsive jet destroys at least one portion of the retaining element 70. The destruction of a portion of the retaining element 70 can be caused by the heat generated by the propulsive jet.

According to an embodiment, the retaining element 70 comprises a retaining wire 7 stretched through the passage opening 8.

In order to stretch the retaining wire 7, the device support 4 and the deflector strip 5 can be configured as follows.

Figure 8:
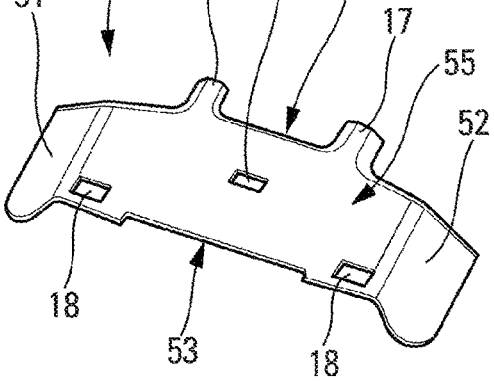
FIG. 8 represents a perspective view of the deflector strip.
Figure 12:
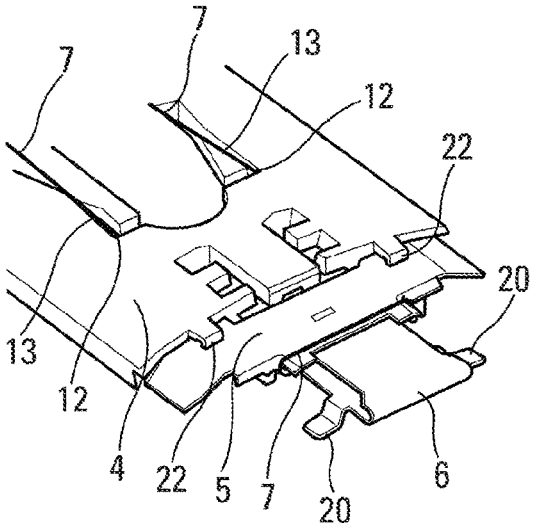
FIG. 12 represents a perspective view of a portion of the outer surface with the deflector strip in the folded position thereof.
Figure 15:
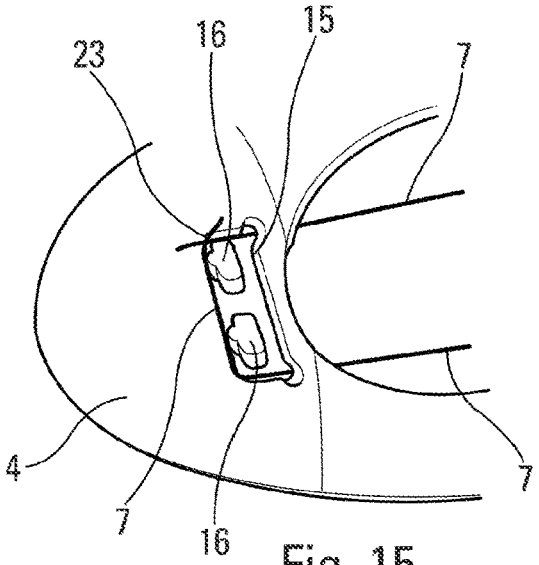
FIG. 15 represents a perspective view of a portion of the inner surface with the retaining wire surrounding the pads.
Figure 16:
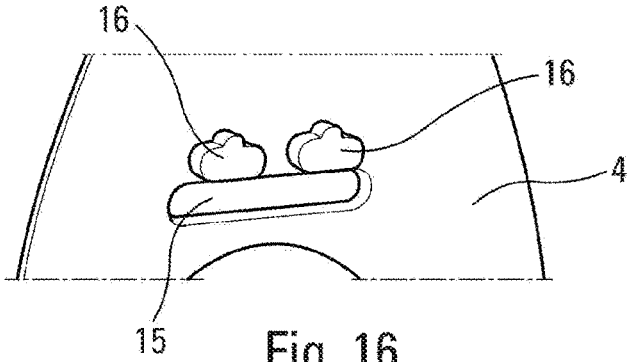
FIG. 16 represents a portion of the inner surface of the device support with the pads and the passage slot.

The inner surface of the device support 4 comprises at least one stud 16 arranged upstream of the passage opening 8 (FIGS. 15 and 16). The deflector strip 5 comprises a first longitudinal end 53 which is in pivot connection with the device support 4 and a second longitudinal end 54 opposite the first longitudinal end 53. The second longitudinal end 54 is provided with at least one flap 17 extending opposite the first longitudinal end 53 (FIGS. 8 and 12).

Figure 13:
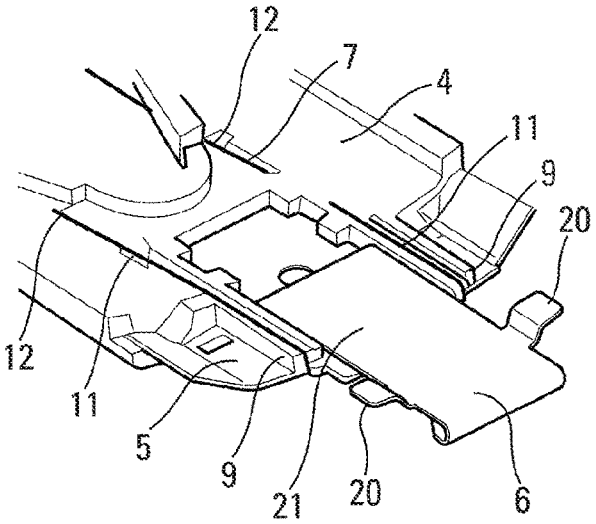
FIG. 13 represents a perspective view of a portion of the inner surface with the deflector strip in the folded position thereof.
Figure 14:
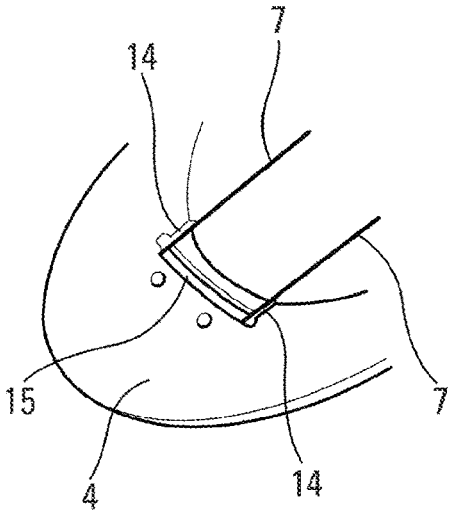
FIG. 14 represents a perspective view of a portion of the outer surface with the retaining wire passing from the outer surface of the device support to the inner surface of the device support through the passage slot.

The retaining wire 7 forms a loop. This loop is arranged to pass around the flap(s) 17 on one side of the loop (FIGS. 12 and 13) and around the pad(s) 16 on the other side of the loop (FIGS. 14 and 15). The loop is capable of bearing on the flap(s) 17 of the deflector strip 5 to maintain said deflector strip 5 in the folded position.

The loop comprises two strands 7 each forming respectively a portion of the loop.

Figure 6:
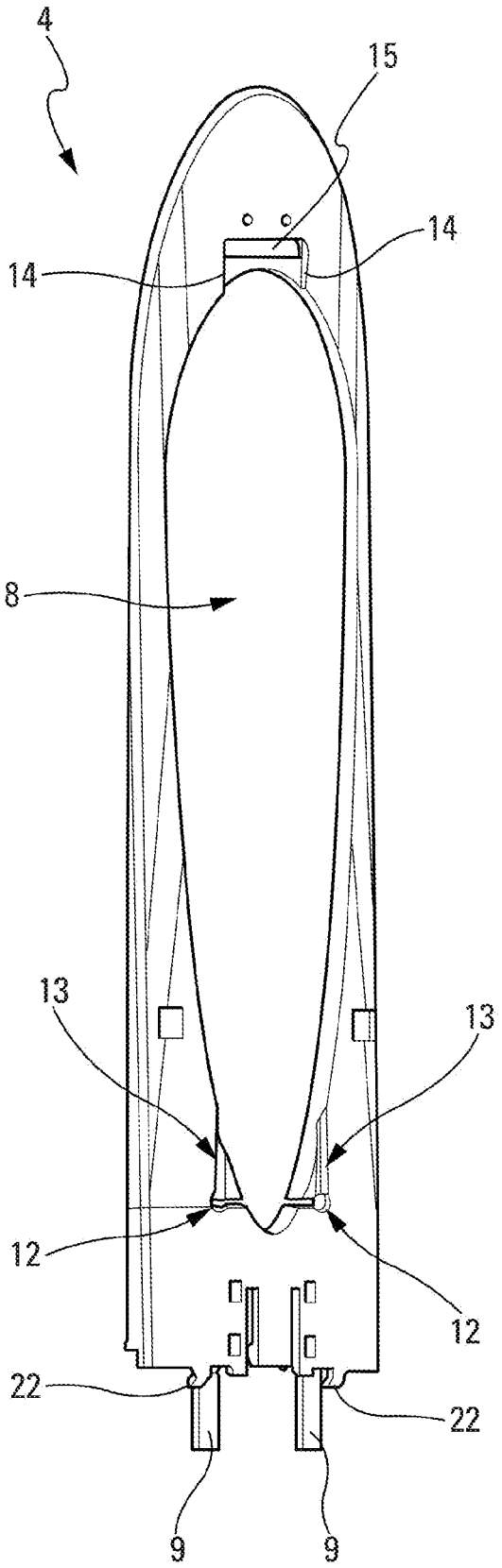
FIG. 6 represents a view of the outer surface of the device support.

Each of the two strands 7 can be arranged to, starting from the flap(s) 17 to the stud(s) 16:

follow at least one lower recess 11 formed on the inner surface of the device support 4 at least partially in the abutment(s) 9 against which the rear face 56 of the deflector strip 5 is supported when the deflector strip 5 is in the folded position (FIGS. 13 and 18), pass from the inner surface of the device support 4 to the outer surface of the device support 4 through an opening 12 arranged through the device support 4 (FIGS. 12, 13 and 18), follow at least one first upper recess 13 formed on the outer surface of the device support 4 (FIGS. 12 and 13), join at least one second upper recess 14 opposite the first upper recess 13 with respect to the passage opening 8 (FIGS. 6 and 14), pass from the outer surface of the device support 4 to the inner surface of the device support 4 through a passage slot 15 formed through the device support 4 (FIGS. 6, 7 and 15).

Figure 19:
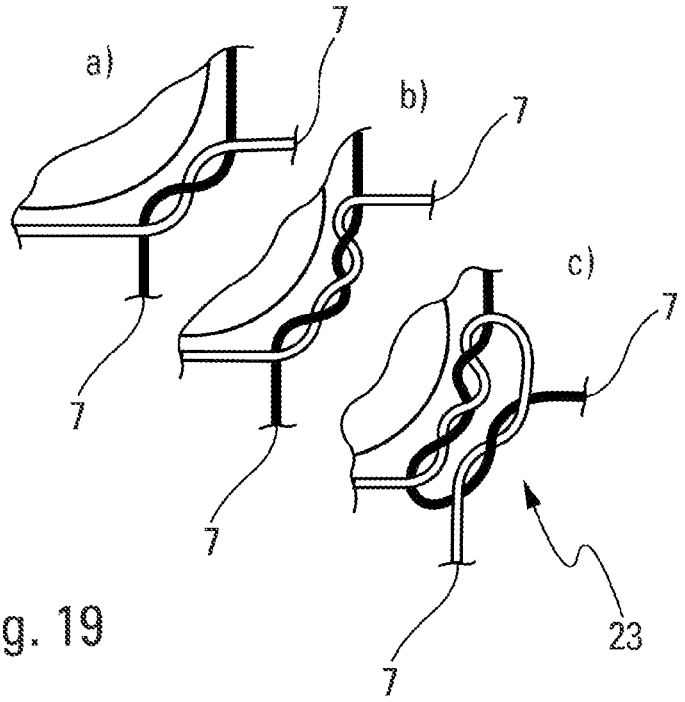

The loop is closed by a set of knots 23 produced at the ends of the retaining wire 7. The set of knots 23 is produced according to the type of retaining wire 7 (material of the wire, thickness, etc.). For example, the set of knots 23 comprises two single knots doubled with a third single knot (FIG. 19).

Advantageously, the retaining wire 7 is attached on the device support 4 by at least one glue point. For example, a glue point can be applied to cover the set of knots 23 to ensure the strength thereof. This avoids any movement of the ends of the retaining wire 7 tending to release the loop, to reduce, even to remove the tension applied to the retaining wire 7 during the production of the set of knots 23. Another glue point can be applied at the level of only one of the lower recesses 11 in the downstream portion of the device support 4 in order to maintain the retaining wire 7 which may remain after the destruction of at least one portion of the retaining wire 7. This makes it possible to avoid any risk of contact between the retaining wire 7 which subsists and the link wire 28.

A knot can also be formed at the front of a lower recess 11 to mechanically retain the retaining wire 7. In addition, several rotations of the retaining wire 7 can be taken around a support stud 33 to also mechanically retain the retaining wire 7.

It is preferable that the deflector strip 5 is in line with the device support 4 when it is presented in the folded position thereof in order to avoid any friction with the launch tube and any risk of collision with the link wire 29. Yet, the retaining wire 7 cannot be stretched as much, such that the deflector strip 5 is in line with the device support 4. In this case, it is possible to stretch the retaining wire 7 by adding at least one interference fit to tighten the two strands of the retaining wire 7 above the passage opening 8. Preferably, the interference fit points are situated in the upstream half of the device support 4.

Figure 4:
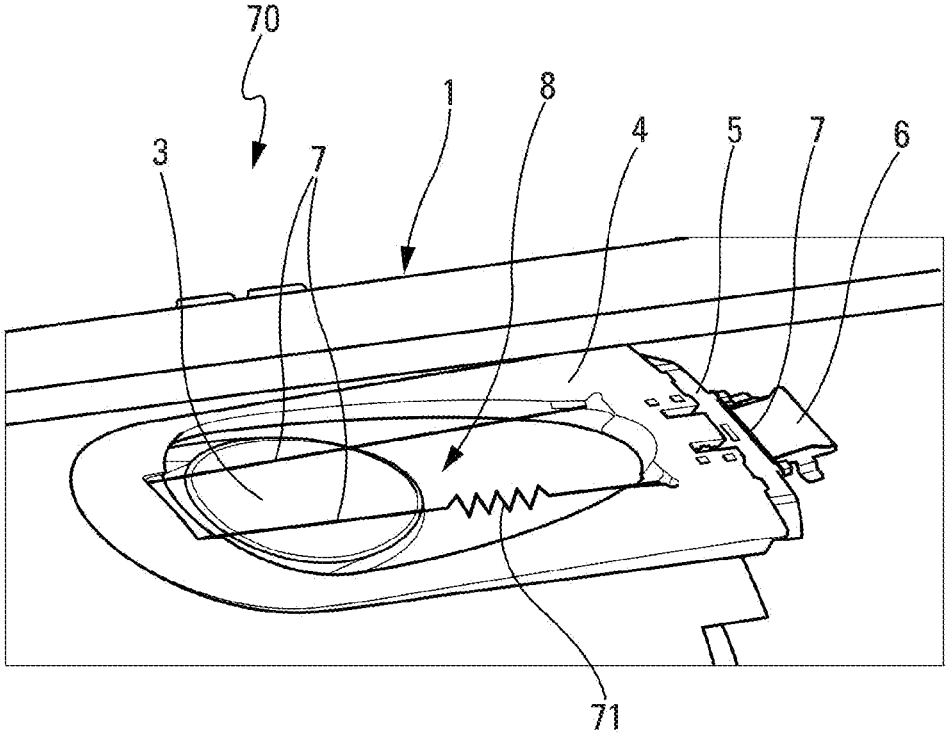
FIG. 4 represents a perspective view of the deflector device in the folded position according to an embodiment.

According to an embodiment, one of the strands of the retaining wire 7 comprises a stretching element 71 configured to conserve tension in the retaining wire 7. FIG. 4 shows an example of a retaining wire 7 comprising a stretching element 71 corresponding to a spring.

The deflector strip 5 is attached in pivotal connection with the device support 4 such that said deflector strip 5 can pass from a folded position to an unfolded position.

Advantageously, the deflector strip 5 comprises a first lateral end 51 and a second lateral end 52. Each of the ends 51 and 52 of the deflector strip 5 are folded towards the fuselage 2.

According to an embodiment, the deflector strip 5 comprises two hinge orifices 18 and the device support 4 comprises two hinge hooks 22. These two hinge hooks 22 are configured to pass respectively into the two hinge orifices 18 in order to attach the deflector strip 5 in pivotal connection with the device support 4.

Preferably, the device support 4 comprises a passage opening 8 configured to surround the ejection outlet 3 of the engine. The deflector strip 5 is situated downstream of the passage opening 8.

The deflector device 1 can function as follows. Before the launch thereof, the projectile 30 is arranged in a launch tube.

The retaining element 70 exerts the second force which exceeds the first force exerted by the return element 6. The retaining element 70 thus maintains the deflector strip 5 in the folded position thereof. After the launch, the projectile 30 flies flat for an instant. At a given moment, the engine produces the propulsive jet which thus destroys at least one portion of the retaining element 70, in particular a portion of the retaining wire 7. The retaining element 70 no longer exerts a second force or exerts a second insufficient force to exceed the first force exerted by the return element 6. The deflector strip 5 is thus brought from the folded position to the unfolded position by the return element 6. The deflector strip 5, in the unfolded position thereof, makes it possible to deflect the stream of particles 29 contained in the propulsive jet.

Preferably, the device support 4 has an aerodynamic shape. For this, the device support 4 has a continually increasing thickness from upstream to downstream. For example, the upstream portion of the device support 4 has a thickness of around 1 mm. This thickness continually increases to the downstream portion to reach a value of around 3.5 mm.

Figure 20:
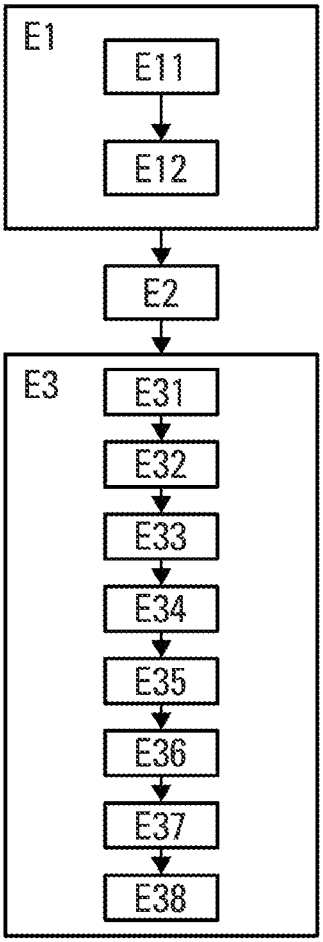

The deflector device can be mounted by a method for assembling the device 1 for deflecting a stream of particles 29 (FIG. 20).

The description below has a step order according to an embodiment. However, the step order is not fixed. For example, certain steps can be reversed with respect to one another.

The method comprises at least one step E2 of putting the deflector strip 5 in place on the device support 4.

According to an embodiment, the method further comprises a step E3 of putting the retaining element 70 in place. The step E2 of implementing the deflector strip 5 is preceded with step E1 of putting the return element 6 in place on the device support 4.

For example, the step E1 of putting the return element 6 in place comprises:

- a sub-step E11 of sliding the spring support 21 into at least one groove 10 of the device support 4,
- a sub-step E12 of blocking the spring support 21 with respect to the device support 4.

For example, the step E2 of putting the deflector strip 5 in place consists of rotatably connecting a pivot, the deflector strip 5 to the device support 4.

For example, the step E3 of putting the retaining element 70 in place comprises:

- a sub-step E31 of applying to the deflector strip 5 a force at least equal to the second force in order to bring the deflector strip 5 in the folded position,
- a sub-step E32 of putting the retaining wire 7 in place around the flaps 17 of the deflector strip 5,
- a sub-step E33 of putting each of the strands of the retaining wire 7 in place such that it follows at least one lower recess 11 formed on the inner surface of the device support 4,
- a sub-step E34 of passing each of the strands of the retaining wire 7 from the inner surface of the device support 4 to the outer surface of the device support 4 through an opening 12 arranged through the device support 4,
- a sub-step E35 of putting each of the strands of the retaining wire 7 in place such that it joins at least one first upper recess 13 formed on the outer surface of the device support 4,
- a sub-step E36 of putting each of the strands of the retaining wire 7 in place such that it joins at least one second upper recess 14 opposite the first upper recess 13 with respect to the passage opening 8,
- a sub-step E37 of passing each of the strands of the retaining wire 7 from the outer surface of the device support 4 to the inner surface of the device support 4 through a passage slot 15 formed through the device support 4,
- a sub-step E38 of knotting the ends of the retaining wire 7.

The invention claimed is:

1. A device for deflecting a stream of particles for a projectile guided by a link wire along a movement direction (F), the projectile having a fuselage and an engine capable of producing a propulsive jet ejected through an ejection outlet of the projectile from upstream to downstream in the movement direction (F), the propulsive jet containing the stream of particles, the device comprising:

- a device support comprising an outer surface and an inner surface, the inner surface being configured to attach to the fuselage of the projectile;
- a deflector strip attached to the device support and configured to be positioned downstream of the ejection outlet of the projectile; and
- an actuation module configured to bring the deflector strip from a folded position in which the deflector strip is situated substantially in line with the device support to an unfolded position in which the deflector strip forms an angle with the device support to deflect the stream of particles away from the fuselage of the projectile.

2. The device according to claim 1, wherein the actuation module comprises:

- a return element configured to exert a first force capable of bringing the deflector strip from the folded position to the unfolded position; and
- a retaining element configured to exert a second force capable of countering the first force to maintain the deflector strip in the folded position,
- wherein the return element is configured to bring the deflector strip from the folded position to the unfolded position, when the propulsive jet destroys at least one portion of the retaining element, the deflector strip being pivotally attached to the device support.

3. The device according to claim 2, wherein the deflector strip comprises a front surface and a rear surface, the rear surface being configured to face the fuselage, the device support having at least one abutment against which at least the rear surface of the deflector strip is supported when the deflector strip is in the folded position.

4. The device according to claim 3, wherein the device support comprises an ejection outlet passage opening, the deflector strip being situated on a downstream side of the ejection outlet passage opening.

5. The device according to claim 4, wherein the retaining element comprises a retaining wire stretched through the ejection outlet passage opening.

6. The device according to claim 5, wherein the inner surface of the device support comprises at least one stud arranged upstream of the ejection outlet passage opening, wherein the deflector strip comprises a first longitudinal end in pivotal connection with the device support and a second longitudinal end opposite the first longitudinal end, the second longitudinal end having at least one flap extending opposite the first longitudinal end, the retaining wire forming a loop arranged to pass around the at least one flap on one side of the loop and around the at least one stud on another side of the loop, the loop being configured to bear on the at least one flap of the deflector strip in order to maintain the deflector strip in the folded position.

7. The device according to claim 6, wherein the loop comprises two strands, each strand being arranged to, starting with the at least one flap to the at least one stud:

follow at least one lower recess formed on the inner surface of the device support at least partially in the at least one abutment against which the rear surface of the deflector strip is supported when the deflector strip is in the folded position, pass from the inner surface of the device support to the outer surface of the device support through an opening arranged through the device support, follow at least one first upper recess formed on the outer surface of the device support, join at least one second upper recess opposite the first upper recess with respect to the ejection outlet passage opening, and pass from the outer surface of the device support to the inner surface of the device support through a passage slot formed through the device support.

8. The device according to claim 6, wherein the loop is closed by a set of knots produced at ends of the retaining wire.

9. The device according to claim 2, wherein the return element comprises a leaf spring, the leaf spring comprising a spring support arranged in at least one groove of the device support, the spring support being provided with pads configured to be supported under the fuselage of the projectile when the device is attached to the fuselage of the projectile.

10. The device according to claim 1, wherein the device support has a continually increasing thickness from upstream to downstream.

11. A projectile, comprising at least one device for deflecting a stream of particles according to claim 1.

12. The projectile of claim 11, wherein the projectile is a missile.

* * * * *